United States Patent [19]

Malott

[11] 3,941,513

[45] Mar. 2, 1976

[54] VARIABLE DISPLACEMENT PUMP CONTROL ASSEMBLY

[75] Inventor: Thomas J. Malott, Mentor, Ohio

[73] Assignee: Parker-Hannifin Corporation, Cleveland, Ohio

[22] Filed: Sept. 5, 1974

[21] Appl. No.: 503,399

[52] U.S. Cl. ..... 417/212; 60/445

[51] Int. Cl.[2] ..... F04B 1/26

[58] Field of Search ..... 60/445; 417/212, 218, 222, 417/213; 91/506

[56] References Cited

UNITED STATES PATENTS

| | | | |
|---|---|---|---|
| 2,845,876 | 8/1958 | Keel | 417/222 |
| 3,067,693 | 12/1962 | Lambeck | 417/219 |
| 3,165,068 | 1/1965 | Burnham et al. | 91/492 |
| 3,601,504 | 8/1971 | McBurnett | 417/213 |
| 3,635,021 | 1/1972 | McMillon | 417/222 |
| 3,738,779 | 6/1973 | Hein | 91/506 |
| 3,750,405 | 8/1973 | Loch | 417/213 |

*Primary Examiner*—William L. Freeh

*Attorney, Agent, or Firm*—Donnelly, Maky, Renner & Otto

[57] ABSTRACT

A variable displacement pump control assembly as for an axial piston pump having a swash plate actuating piston characterized in that the control assembly is embodied in the pump housing to provide a pressure compensated pump, or to provide a pressure compensated pump having an auxiliary modulator to control the pressure applied to the swash plate actuating piston to maintain a predetermined pressure drop across a variable area metering orifice embodied as in a directional control valve for a fluid motor, or to provide a pressure compensated pump having a horsepower modulator with or without the auxiliary modulator, said horsepower modulator providing desired control of horsepower in relation to pump delivery pressure and displacement.

15 Claims, 5 Drawing Figures

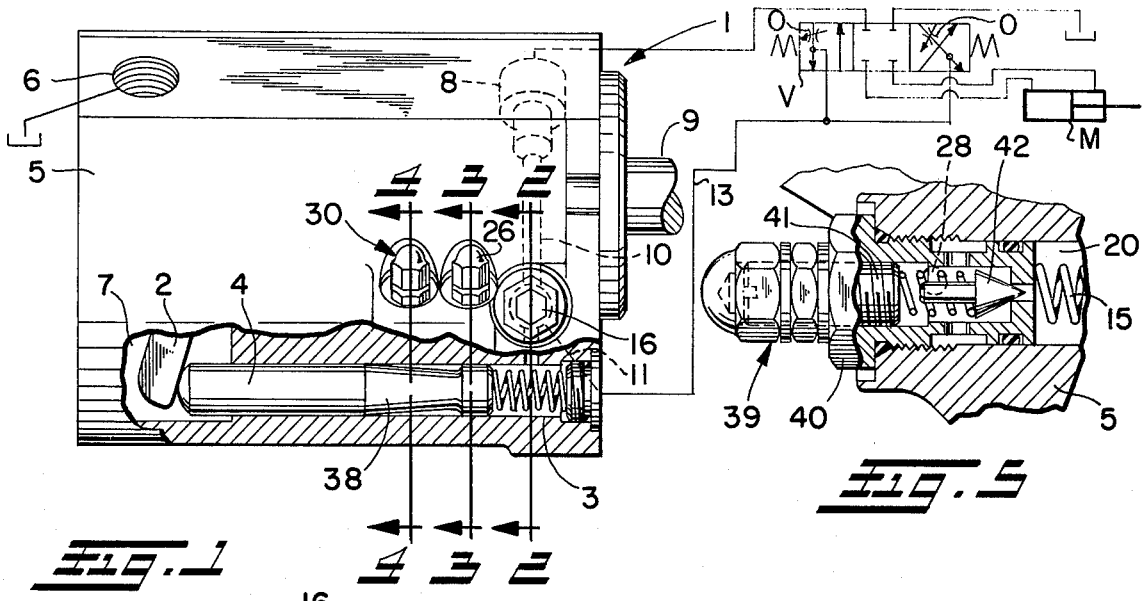
FIG. 1
FIG. 5
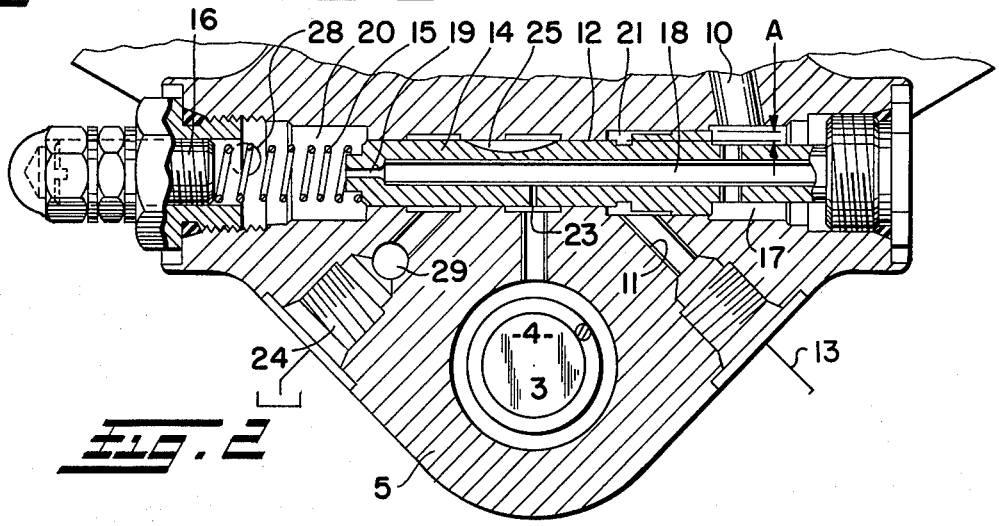
FIG. 2
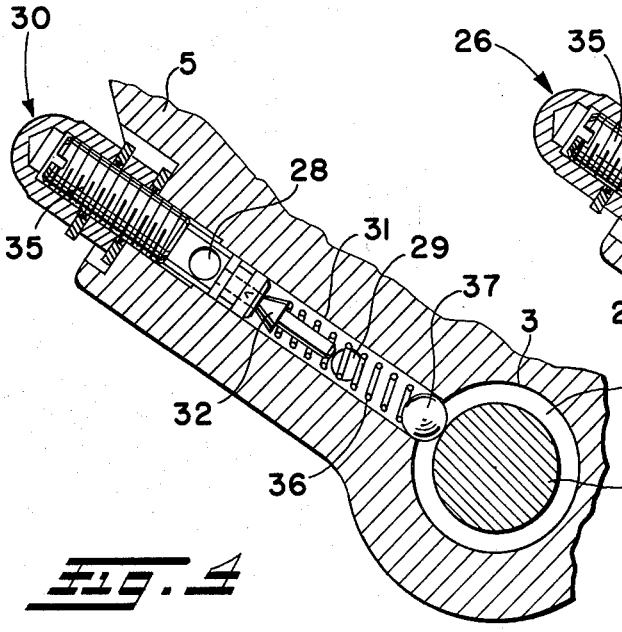
FIG. 4
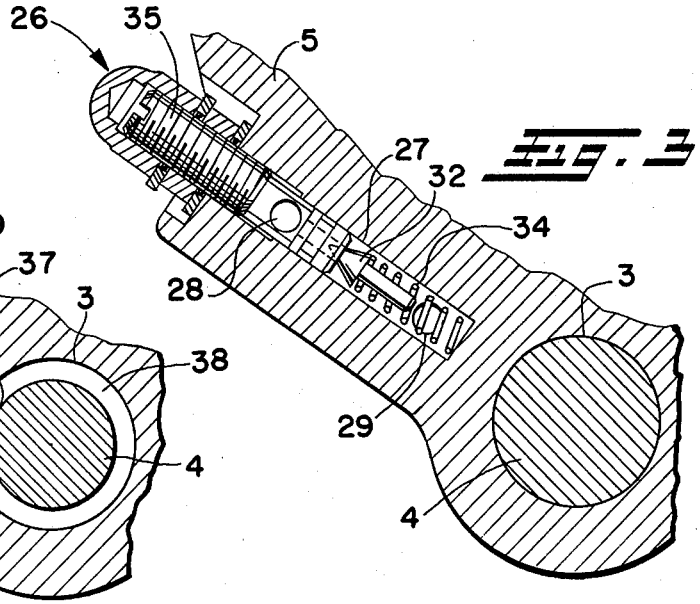
FIG. 3

VARIABLE DISPLACEMENT PUMP CONTROL ASSEMBLY

BACKGROUND OF THE INVENTION

Axial piston variable displacement pumps with hydraulic swash plate actuators are well known in the art but in known constructions when it is desired to provide for pressure compensation with or without auxiliary modulation or to provide for pressure compensation with horsepower modulation (with or without auxiliary modulation), it has been necessary to provide a corresponding number of different pump housings or pump control assemblies with attendant substantially increased production and inventory costs.

SUMMARY OF THE INVENTION

The variable displacement pump control assembly herein is embodied in a single form of pump housing to selectively provide for pressure compensation, for pressure compensation with auxiliary modulation, for pressure compensation with horsepower modulation, or for pressure compensation with both auxiliary and horsepower modulation.

Other objects and advantages will appear from the ensuing description.

BRIEF DESCRIPTION OF THE DRAWING

FIG. 1 is a side elevation view, partly in cross-section, of a variable volume pump in which the housing thereof embodies the pump control assembly;

FIGS. 2, 3 and 4 are cross-section views taken substantially along the lines 2—2, 3—3, and 4—4 of FIG. 1; and FIG. 5 is a fragmentary cross-section view similar to FIG. 2 illustrating a modification.

DETAILED DESCRIPTION OF THE PREFERRED EMBODIMENTS

The pump 1 herein shown by way of illustrative example is an axial piston pump such as that shown in U.S. Pat. No. 3,726,093 in which the displacement is varied by changing the angular position of the swash plate 2, such change in swash plate angle being hydraulically effected by control of fluid pressure in the bore 3 in which the swash plate actuating piston 4 is axially movable. The pump housing 5 has an intake port 6 leading into the intake chamber 7 and has an outlet or delivery port 8 from which fluid under pressure is delivered upon driving of the drive shaft 9 which is journaled in said housing 5 in well known manner.

The pump 1 illustrated in FIGS. 1 to 4 provides for pressure compensation, auxiliary modulation, and horsepower modulation, all of which functions are accomplished in the unitary pump housing 5 and, as hereinafter explained in detail, the auxiliary modulation and/or the horsepower modulation may be omitted without any changes in the pump housing 5 other than plugging unused passages.

In the use of FIGS. 1 through 4 pump 1, the outlet port 8 may be connected to the inlet port of a directional control valve V assembly and, in turn, the motor ports of the directional control valve V assembly will be connected to a fluid motor M. In a preferred form of application of the pump 1, the directional control valve V assembly may define therewithin a variable area orifice O which is of size depending upon the extent of movement of the valve member thereof to an operating position thus to vary the speed of actuation of the fluid motor M irrespective of load pressure. Accordingly, the pump 1 control should maintain a predetermined pressure drop across such variable area orifice O.

The pump housing 5 herein is provided with high and low signal passages 10 and 11 which respectively sense the pressures upstream and downstream of such variable area orifice O, the high signal passage 10 communicating with the outlet port 8, and the low signal passage 11 being communicated by conduit 13 with the downstream side herein and of the variable area orifice O as shown, for example, in said U.S. Pat. No. 3,726,093 and in the copending U.S. application of John C. Paul, Ser. No. 394,560, filed Sept. 6, 1973.

Within a stepped bore 12 in the pump housing 5 is an auxiliary modulator 14 which is urged to the position shown in FIG. 2 by a spring 15 which is adjusted to desired compression by the adjusting screw 16. The high signal pressure in the passage 10 is conducted to the chamber 17 at the right end of modulator 14, and through the modulator bore 18 and orifice 19 into the chamber 20 at the left end of modulator 14 whereby the high signal pressure acts on the annular area A tending to urge the modulator 14 toward the left.

The low signal pressure in the passage 11 is conducted to the chamber 21 of annular area A to tend to move the modulator 14 to the position shown together with the assistance of the spring 15 when the pressure differential between the high and low signals is less than desired predetermined value hence indicating a flow through a variable area orifice O less than demanded thereby. Accordingly, the high signal pressure in passage 10 and chamber 17 is conducted to the piston bore 3 via the modulator orifice 23 to move the swash plate actuating piston 4 in displacement increasing direction. When the pump 1 displacement satisfies the flow demand set by the variable area orifice O, the pressure drop therethrough has increased and, hence the pressure differential in the chambers 17 and 21 has increased whereby the modulator 14 will be urged to the left against the spring 15 with metered bleeding of the piston bore 3 to the drain port 24 via the metering slot 25 in the modulator 14 thus to maintain the pump 1 displacement to satisfy the demanded flow.

The chamber 20 at the left end of the modulator 14 which has communication with the high signal pressure passage 10 via the bore 18 and orifice 19, is normally closed, but under certain conditions of operation of the pump 1, said chamber 20 is communicated with the drain port 24 either by a constant pressure pilot valve assembly 26 (FIG. 3) disposed in a bore 27 which interconnects the parallel bores 28 and 29 leading respectively to the chamber 20 and to the drain port 24 as shown in FIGS. 2 and 3, or by a horsepower control pilot valve assembly 30 (FIG. 4) disposed in a bore 31 which also interconnects the parallel bores 28 and 29.

Referring now to FIGS. 1, 2 and 3 it can be seen that when the high signal pressure in chamber 20 increases to value sufficient to unseat the pilot valve member 32 against the force of the spring 34, the chamber 20 will be communicated with the drain port 24 via passages 28, 27, and 29 and hence the pressure in the chamber 20 will decrease with respect to the pressure in chamber 17 by reason of the pressure drop across the orifice 19 in the modulator 14 whereby the predominant pressure in chamber 17 acting on the right-hand end of the modulator 14 will force the same toward the left to bleed the swash plate piston chamber 3 through slot 25 thus to decrease the capacity of the pump 1. When the pressure in the modulator chamber 20 decreases below such predetermined value the pilot valve member 32 closes whereby the movements of the modulator 14 are then controlled by the high signal and low signal pressure differentials to maintain the flow demanded by the variable area orifice O associated with the directional control valve V for the fluid motor M. The constant pressure pilot valve 26 comprises a body 35 having adjustable screw threaded engagement with the pump 5 housing and is provided with a seat with which the pilot valve member 32 is engaged. By reason of the screw threaded engagement of the body 35 in the pump housing 5, the compression of the spring 34 may be adjusted to vary the opening pressure of the pilot valve member 32.

With reference to FIGS. 1, 2 and 4 the horsepower control pilot valve 30 is similar to the constant pressure pilot valve 26 in that it also comprises a body 35 having an adjustable screw threaded connection with the pump housing 5 and is provided with a seat engaged by the pilot valve member 32. In this case, the spring 36 is compressed between the pilot valve member 32 and a ball 37 which has engagement with a cam surface 38 on the swash plate piston 4, the cam surface 38 being shaped to provide desired characteristics in the horsepower curve of the pump 1. As the displacement of the pump 1 decreases, i.e. as the swash plate piston 4 moves toward the right as viewed in FIG. 1, the ball 37 is urged radially outward (see FIG. 4) to increase the compression of the spring 36 and thus to increase the pressure at which the horsepower control pilot valve member 32 opens, and as just described in connection with the constant pressure pilot valve 26, the opening of the horsepower control pilot valve 30 will communicate the modulator chamber 20 with the drain port 24 via passages 28, 31, and 29 whereby the modulator 14 can then again move to the left as viewed in FIG. 2 to bleed off the pressure in the chamber 3 of the swash plate piston 4. It is to be understood that the cam surface 38 may be provided with a straight taper as shown or a concave or convex taper to provide any desired characteristics in the horsepower curve of the pump 1.

It is to be understood that if the pump 1 is to be pressure compensated with auxiliary modulation but without horsepower modulation it is a simple matter to omit the entire horsepower control pilot valve 30 and to screw in a plug to close the bore 31 between the bores 28 and 29. Similarly, if the pump 1 is to be pressure compensated with horsepower modulation but without auxiliary modulation, a plug is installed into the pump housing 5 to close the low signal passage 11 and no adjustment mechanism 16 need be provided for the spring 15, i.e. a plug may be substituted for the spring adjusting mechanism 16 shown in FIG. 2.

A still further modification of the pump control mechanism is contemplated in FIG. 5 wherein the pump 1 is pressure compensated without either auxiliary modulation or horsepower modulation and in that case plugs are provided in the outer ends of the horsepower and constant pressure pilot valve bores 31 and 27 and also in the low signal port of passage 11, the pilot valves 26 and 30 being omitted. In this case, a constant pressure pilot valve 39 is installed in the modulator bore with the end of the body 40 engaging the modulator spring 15 without adjustment and within the pilot valve body 40 is an adjusting screw 41 for adjusting the opening pressure of the pilot valve member 42.

When the pilot valve member 42 is opened by the pressure in chamber 20 reaching a predetermined value, the chamber 20 is communicated with the drain port 24 via the passages 28, 31, 27 and 28 to decrease the pressure in the chamber 20 with respect to the pressure in the chamber 17 to urge the modulator 14 to the left to bleed off the swash plate piston chamber 3 to thus provide the pressure compensation feature. When the pressure in chamber 20 drops to desired value, the pilot valve member 42 closes for equalization of the pressure in the chambers 17 and 20 to urge the modulator 14 toward the right to subject the swash plate piston 4 to the higher pressure via the orifice 23 to tend to increase the displacement of the pump 1.

The embodiments of the invention in which an exclusive property or privilege is claimed are defined as follows:

1. Pressure compensating means for a variable displacement pump of the type including a housing having pump means, high and low fluid pressure zones, and a fluid pressure operated number operatively engaged with said pump means to vary the displacement thereof, said fluid pressure operated member having restricted fluid communication with said high pressure zone; said pressure compensating means comprising a valve member movable in said housing to open and close a bleed passage from said fluid pressure operated member to said low pressure zone and having first opposed areas including an area on one side thereof exposed to fluid pressure in said high pressure zone and an area on the other side exposed to fluid pressure in said high pressure zone via orifice means; spring means in said housing biasing said valve member to bleed passage closing position; said valve member having second opposed areas respectively exposed to said high pressure zone and to a pressure sensing passage which is communicated with the downstream side of a variable area orifice in the pressure feed path from said high pressure zone to a fluid motor actuated by fluid under pressure flowing through said variable area orifice from said high pressure zone; and a pilot valve in said housing opened upon increase of fluid pressure in said high pressure zone to predetermined magnitude to bleed fluid pressure acting on the area on said other side of said valve member to said low pressure zone whereby predominant fluid pressure upstream of said orifice means acting on the area on said one side of said valve member is effective to move said valve member to a position to open said bleed passage to said low pressure zone thus to decrease the fluid pressure acting on said fluid pressure operated member via said restricted communication for movement of said fluid pressure operated member in a direction to decrease the capacity of said pump means until the fluid pressure in said high pressure zone decreases to less than such predetermined magnitude to permit closing of said pilot valve and consequent equalization of the fluid pressures acting on the first opposed areas of said valve member and movement of said valve member to close said bleed passage; said valve member, while said pilot valve is closed, being moved to bleed passage opening position against said spring means when the fluid pressure differential acting on said second opposed areas exceeds a predetermined value.

2. The pressure compensating means of claim 1 wherein said valve member is a valve spool movable in a bore in said housing, said spool having said orifice means therein and having another orifice means providing such restricted communication between said high pressure zone and said fluid pressure operated member.

3. The pressure compensating means of claim 2 wherein said spool has a groove which, when said sppol is moved as aforesaid by opening of said pilot valve, forms said bleed passage.

4. The pressure compensating means of claim 3 wherein said pilot valve is disposed in said housing bore adjacent said other side of said spool; and wherein said spring means is compressed between said pilot valve and said other side of said spool to bias the latter to tend to close said bleed passage when said pilot valve is closed.

5. The pressure compensating means of claim 1 wherein said valve member defines a metering bleed passage to adjustably meter the flow of fluid through said bleed passage to seek to maintain such pressure differential at such predetermined value.

6. The pressure compensating means of claim 5 wherein said housing has adjusting means for said spring means to change the pressure differential at which said valve member is thus moved to bleed passage metering position.

7. The pressure compensating means of claim 6 wherein said valve member is a valve spool movable in a bore in said housing; wherein said adjusting means is disposed in the end of said bore adjacent said other side of said spool; and wherein said pilot valve is disposed in another bore in said housing, said housing having passages leading from the respective upstream and downstream sides of said pilot valve to said area on the other side of said spool and to said low pressure zone.

8. Pressure compensating means for a variable displacement pump of the type including a housing having intake, delivery, and drain ports, pump means in said housing operative to deliver fluid under pressure from said intake port to said delivery port, and a piston reciprocable in a first bore in said housing exposed to fluid under pressure in said delivery port via first orifice means in said housing and being engaged with said pump means to vary the displacement of said pump means according to the magnitude of the pressure in said delivery port; said housing having a second bore intersected by passages communicating with said delivery port, with said first bore, and with said drain port; said pressure compensating means comprising a valve member reciprocable in said second bore between first and second positions closing and opening communication between said first bore and said drain port, said valve member having one end portion exposed to fluid pressure in said delivery port and an opposite end portion exposed to fluid pressure in said delivery port via second orifice means in said housing; spring means in said housing biasing said valve member to said first position; and a pilot valve in said housing opened responsive to increase in fluid pressure in said delivery port to predetermined magnitude to bleed fluid pressure acting on said opposite end portion to said drain port whereby predominant fluid pressure in said delivery port acting on said one end portion is effective to move said valve member to said second position to provide a bleed passage to said drain port from said first bore thus to decrease the fluid pressure in said first bore for movement of said piston in a direction to decrease the capacity of said pump means until the fluid pressure in said delivery port and acting on said pilot valve is less than such predetermined magnitude to permit closing of said pilot valve with consequent equalization of fluid pressure acting on said end portions of said valve member and movement of the latter to said first position; said valve member having opposed areas respectively exposed to fluid pressure in said delivery port and to fluid pressure in a sensing passage which intersects said second bore and which is communicated with the downstream side of a variable area orifice in the pressure feed path from said delivery port to a fluid motor actuated by flow of fluid through said variable area orifice from said delivery port to said fluid motor; a predetermined fluid pressure differential acting on said opposed areas being effective to move said valve member to said second position against said spring means to bleed said first bore to said drain port thus to decrease the fluid pressure in said first bore for movement of said piston in a direction to decrease the capacity of said pump means.

9. The pressure compensating means of claim 9 wherein said pilot valve is in said second bore with said spring means being compressed between said pilot valve and said other end portion of said valve member; and wherein said housing has a passage which, when said pilot valve is open, conducts fluid from said other end portion to said drain port.

10. The pressure compensating means of claim 8 wherein said valve member, when moved as aforesaid by fluid pressures acting on said opposed areas, adjustably meters the flow of fluid through said bleed passage thus to tend to maintain a predetermined pressure differential between fluid pressure in said delivery port and in said sensing passage.

11. The pressure compensating means of claim 10 wherein said housing has adjusting means for said spring means to change the pressure differential at which said valve member moves toward said second position.

12. The pressure compensating means of claim 11 wherein said adjusting means is in said second bore; and wherein said pilot valve is in a third bore in said housing, said housing having passages respectively leading from said opposite end portion to the upstream side of said pilot valve and from the downstream side of said pilot valve to said drain port.

13. Pressure compensating means for a variable displacement pump of the type which includes a pressure chamber to which fluid pressure from the high pressure zone of said pump is conducted by way of a restricted passage to act on a pump displacement varying means in said chamber; said pressure compensating means comprising a pilot operated valve assembly having a pilot valve member which opens and closes communication between the high and low pressure zones of said pump responsive to the fluid pressure in said high pressure zone being greater than or less than predetermined magnitude, and a main valve member in said pump having first opposed areas respectively exposed to said high pressure zone and to said high pressure zone via orifice means in said main valve member, said main valve member being moved upon opening of said pilot valve to provide a bleed passage from said chamber to said low pressure zone when said pilot valve is open and to close said bleed passage when said pilot valve is closed, said bleed passage when open decreasing the fluid pressure in said chamber for movement of said pump displacement varying means for decreased displacement of said pump; spring means in said pump biasing said main valve member to bleed passage closing position when said pilot valve is closed, said main valve member moving against said spring bias means to open said bleed passage when said pilot valve is open; said main valve member having second opposed areas respectively exposed to said high pressure zone and to a fluid pressure sensing passage in said pump which is communicated with the downstream side of a variable area orifice in the pressure feed path from said high pressure zone to a fluid motor actuated by fluid under pressure flowing through said variable area orifice from said high pressure zone; said main valve member being moved to bleed passage opening position while said pilot valve is closed when the differential between fluid pressure in said high pressure zone and fluid pressure in said sensing passage exceeds the bias force of said spring means.

14. The pressure compensating means of claim 13 wherein said main valve member meters the flow through said bleed passage to tend to maintain a substantially constant differential between fluid pressure in said high pressure zone and fluid pressure in said sensing passage.

15. The pressure compensating means of claim 13 wherein said pump is provided with spring adjusting means to vary the bias force of said spring means on said main valve member for adjusting the pressure differential at which said main valve member is thus moved to open said bleed passage while said pilot valve is closed.

* * * * *